US006145780A

United States Patent [19]

Fontana

[11] Patent Number: 6,145,780

[45] Date of Patent: Nov. 14, 2000

[54] PORTABLE DEVICE FOR DISPENSING CABLES

[75] Inventor: Bruno Fontana, S. Martino Siccomario, Italy

[73] Assignee: Italiana Conduttori S.R.L., Gropello Cairoli, Italy

[21] Appl. No.: 09/230,610

[22] PCT Filed: Jul. 26, 1997

[86] PCT No.: PCT/EP97/04162

§ 371 Date: Jan. 27, 1999

§ 102(e) Date: Jan. 27, 1999

[87] PCT Pub. No.: WO98/04489

PCT Pub. Date: Feb. 5, 1998

[30] Foreign Application Priority Data

Jul. 31, 1996 [IT] Italy ..... PV96U0009
Jul. 9, 1997 [IT] Italy ..... MI97U0510

[51] Int. Cl.[7] ..... B65D 85/02; B65H 16/00

[52] U.S. Cl. ..... 242/588.1; 242/588.6; 242/613.1; 242/613.2; 242/609.2; 242/407; 242/400

[58] Field of Search ..... 242/588.1, 588.3, 242/396.6, 613, 613.1, 613.2, 400, 588.6, 407, 609.2, 407.1; 191/12.2 R

[56] References Cited

U.S. PATENT DOCUMENTS

| | | | |
|---|---|---|---|
| 1,990,135 | 2/1935 | Sato | 242/588.1 |
| 3,614,067 | 10/1971 | Vermette | 242/396.6 |
| 4,274,606 | 6/1981 | Bernwall et al. | 242/118 X |

FOREIGN PATENT DOCUMENTS

| | | | |
|---|---|---|---|
| 1 260 445 | 9/1989 | Canada . | |
| 0 570 302 | 11/1993 | European Pat. Off. . | |
| 000647717 | 7/1937 | Germany | 242/613.2 |
| 4202218 | 7/1993 | Germany | 242/613.1 |
| 000314068 | 9/1934 | Italy | 242/613.2 |
| 360137 782 | 7/1985 | Japan | 242/613.2 |
| 2 108 929 | 5/1983 | United Kingdom . | |

*Primary Examiner*—John Q. Nguyen
*Attorney, Agent, or Firm*—Hoffmann & Baron, LLP

[57] ABSTRACT

An apparatus for dispensing electrical or nonelectrical cables, such as television coaxial cables, and a spool to be used together therewith. The apparatus includes a container having a cover for introducing and extracting a spool holding a cable coil and wheels for supporting, centering, and freely rotating the spool inside the container. The spool includes male and female mutually mating flanges. Each of the flanges include an inwardly projecting central part having a frusto conical shape for blocking the innermost turns of the cable coil. At least one of the flanges includes a circular race in which an elastic ring is inserted for assuring cable dragging during rewinding or unwinding of the spool.

15 Claims, 5 Drawing Sheets

PORTABLE DEVICE FOR DISPENSING CABLES

BACKGROUND OF THE INVENTION

1. Field of the Invention

The present invention relates to a spool holder for electrical or non electrical cable coils, like the television coaxial cables, and a spool to be used together with such a holder.

2. Description of the Prior Art

At present, cable coils are wound on a plastic bobbin which, when the able is fully used, is thrown out or, sometimes, returned to the supplier. This kind of spool packaging is surely uncomfortable and not much ecological because there is a lot of plastic thrown out, especially since a bobbin may have large size, as it is usually wound also by a 250 meters of cable.

Another disadvantage of this kind of packaging is the considerable cost of the plastic bobbin which, as said before, often has a large size.

To reduce costs and have a more ecological packaging, coils were devised wound in a way to be unthreaded from their support: the coils, without the spool, were accomodated or inserted in a cardboard container, material which could be recycled easier than plastic. A disadvantage of this kind of packaging is the considerable complexity in rewinding the cable. The known systems are also not practical for the user or installer, which is often obliged to work in uncomfortable positions, like on ladders top, and to carry a cable spool having at least one hand busy: it goes without saying that in this case the user equilibrium on the ladder is really unstable to the detriment of his safety.

Document CA-A-1260445 discloses a spool holder for heavy duty wire, including a container provided with a cover or door for the introduction and extraction of a spool, provided with a male and female flange with a projecting central part, but does not deal with the problems caused by thin cables in a portable dispensing device, and more particularly that of avoiding free rotation of the coil around the spool and improving drag on the coil during unwinding and rewinding operations. Rewinding of the heavy wire dispensed in excess is a difficult operation requiring opening of the holder.

Document EP-A-0570302 discloses a portable box for wire, cable or the like showing the same problems affecting the device of CA-A1260445 and moreover excluding the possibility of rewinding the cable paid-off in excess as the reel is provided with a rachet wheel mechanism.

OBJECTS AND SUMMARY OF THE INVENTION

The above-mentioned problems and disadvantageous are brilliantly solved by a device for dispensing cable having the features recited in the characterizing part of independent claim 1. The dependent claims define further advantageous features of the device according to the invention.

The inventive spool holder substantially consists of a box like container supplied with a lid which can be closed again to obtain a comfortable fitting of a spool provided with a cable coil, and also its extraction when it is fully consumed. The spool inside the holder of the present invention has an anti/clockwise free movement so to unwind the right length of cable but also to partially rewind it when it is too long.

The inventive spool is "sectional" i.e. consisting of two cooperating flanges to block a cable coil, and removable to receive another coil when the first one is finished.

BRIEF DESCRIPTION OF THE DRAWINGS

Now follows a detailed description of an invention embodiment, by way of example non limiting the invention itself, reference having made to the respective accompanying drawings which.

Of course, similar reference characters refer to similar parts throughout the various figures of the drawings.

DETAILED DESCRIPTION OF THE PREFERRED EMBODIMENTS

Figure 1:
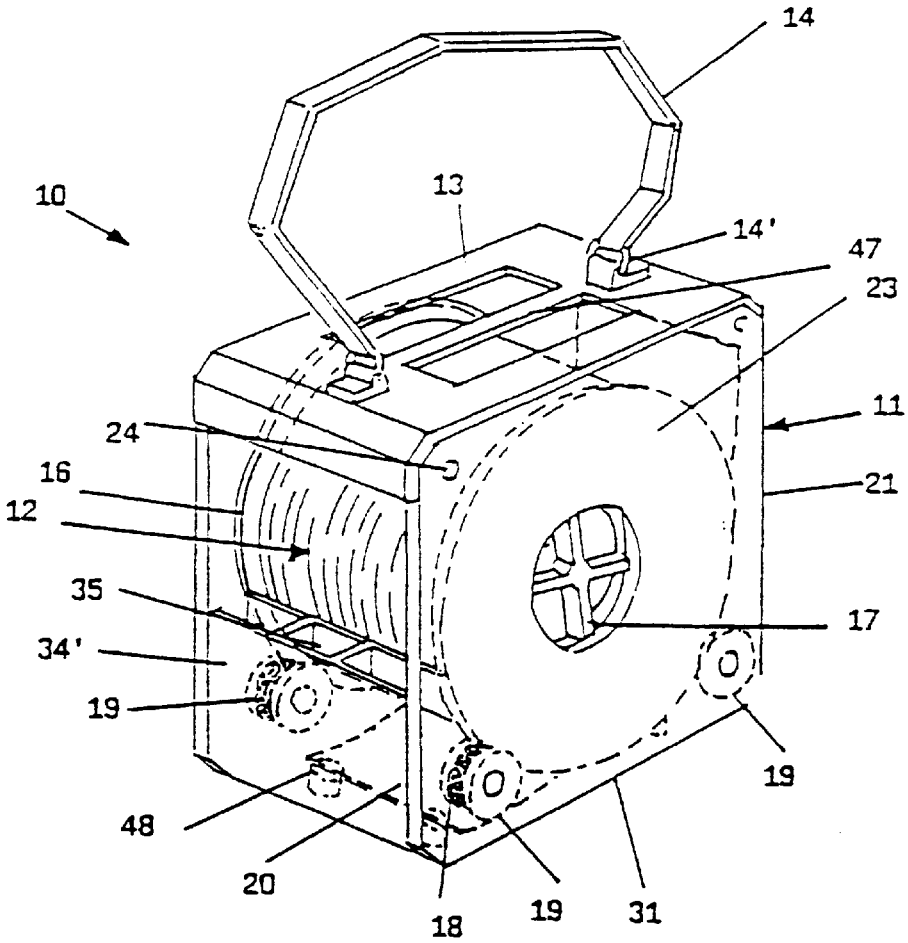
FIG. 1 is a perspective view of the spool holder according to the present invention, in which some of the internal (or non visible) sections are drawn by dotted lines.
Figure 2:
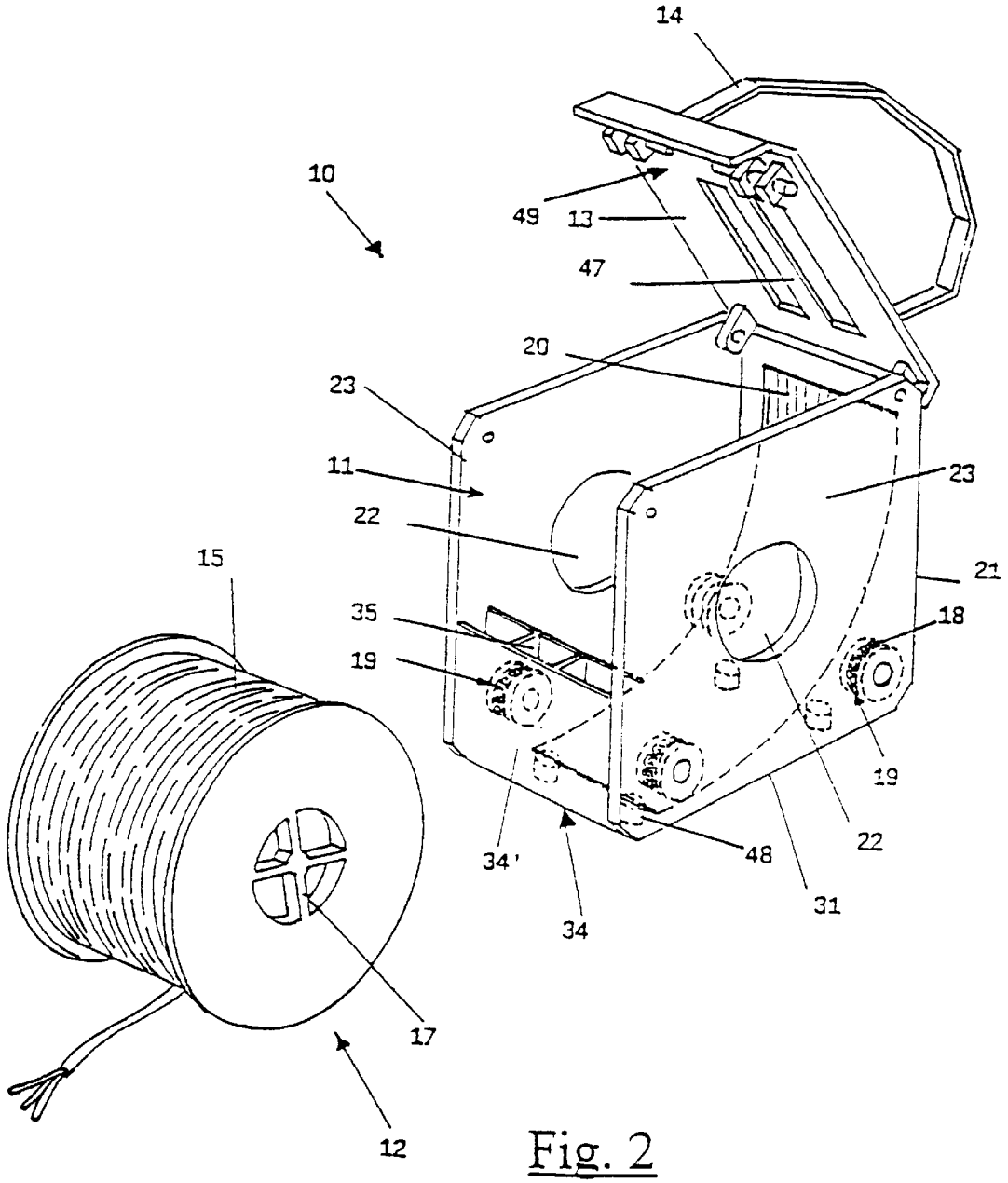
FIG. 2 is a perspective view of the same spool holder shown in FIG. 1, but with the raised door to allow the fitting of the spool provided with a coil.

Referring first to FIGS. 1 and 2, reference numeral 10 generally designates a spool holder including a container 11 housing a spool 12. The container 11 is provided with a cover or door 13 provided with a couple of rings 14 to anchor a belt or a shoulder-strap 14, to make easier to the user the conveyance of the container 11 mainly when he has to climb up ladders or is working in uncomfortable or impracticable places. Preferably, a handle 47 is obtained or applied on the cover 13.

The cover is hinged near one of the upper corners of the lateral surfaces 23 of the container and is provided with a couple of spring door latches 49 for being releasingly locked to the container lateral surfaces 23 near the other upper corner of said lateral surfaces; at least one of these lateral surfaces is provided with an opening 22 near its central section.

Figure 3:
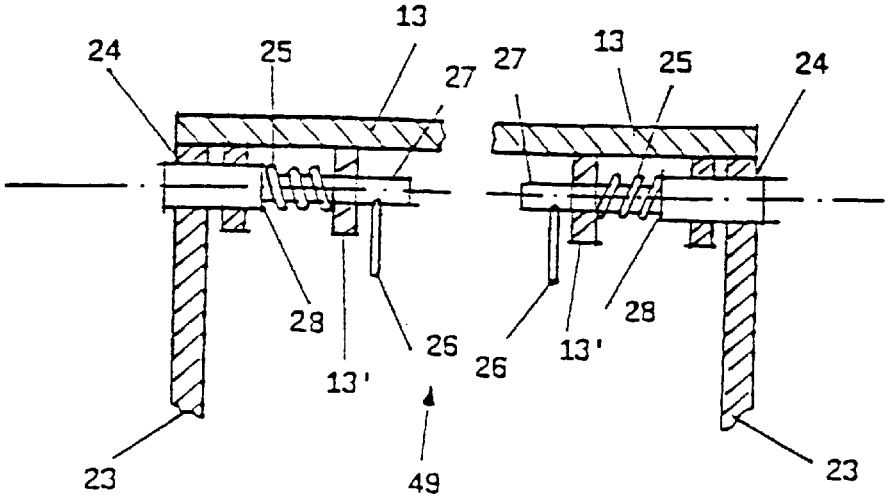
FIG. 3 shows the locking door latches of the spool holder shown in FIG. 1.

FIG. 3 shows the couple of door latches according to the presently preferred embodiment. In practice, there are two bolts 27 which are normally pushed outwards by two wire springs 25 placed around an intermediate portion of bolts 27, between a bolt shoulder 28 and a shoulder 13' integral with the cover 13; in the closed condition, the outer end of the bolts 27 engages corresponding holes 24 in the lateral surfaces. The cover unlocking occurs when approaching with two fingers the projections 26 located near the inner end of the two bolts 27.

Opposite the cover or door 13 there is a bottom 31 from which protrude non-slip or non-slide stoppers 48 preventing that the spool holder, when standing on a flat surface, be dragged out during the cable unwinding.

Figure 6:
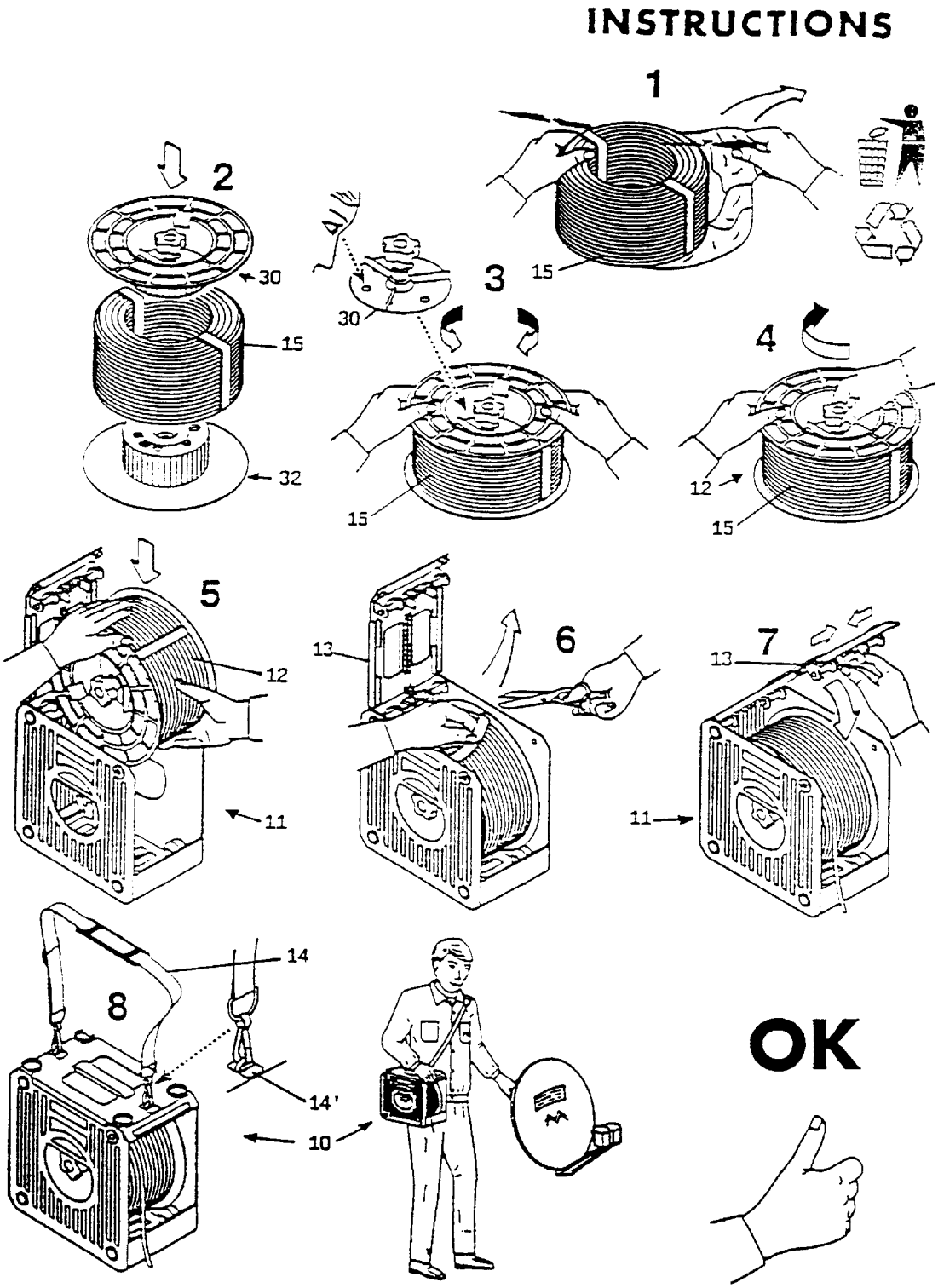
FIG. 6 is a scheme of the different steps to load the cable coil on the spool and to prepare the spool holder according to the present invention.

The container of the present invention is completed by a rear side 21 and a front side 34. Preferably, the rear side 21 is substantially fully closed and can suitably be used like base for applying a label or card, showing in a clear and synthetic way how to use the spool holder and the spools according to the present invention; FIG. 6 shows by way of example a sample of such an instruction diagram.

The front side 34', however, is preferably almost fully open, except for a lower strip 34', all this not to make unduly heavier the container, to make the spool fitting easier, and to allow the user to check the amount of the cable left.

In a particularly advantageous embodiment, near the lower strip 34' a set of housings 35 is obtained to hold tools such snips, pliers, wire removers, screw drivers and so on (not illustrated), that user always wants to have at hand.

Inside the container there is an elastic friction strap 20, the function of which will be made clear hereinafter. One end of the strap 20 is rear side 11 while the other end is fixed to the inner surface of the bottom 31. The width, length and elasticity of the strap 20 will allow it to match the shape of the cable coil 15 arranged on the spool 12, described below, and to adhere to the outermost cable winding.

Inside the container 11, near the lower corners of the two lateral surfaces 23, are provided freely rotating wheels 19 having respective races 18, the base of which is preferably covered by a rubber band.

Once completed the spool holder detailed description, the structure of the spool 12 of the present invention, to be used together with it, will now be described in detail.

Figure 4:
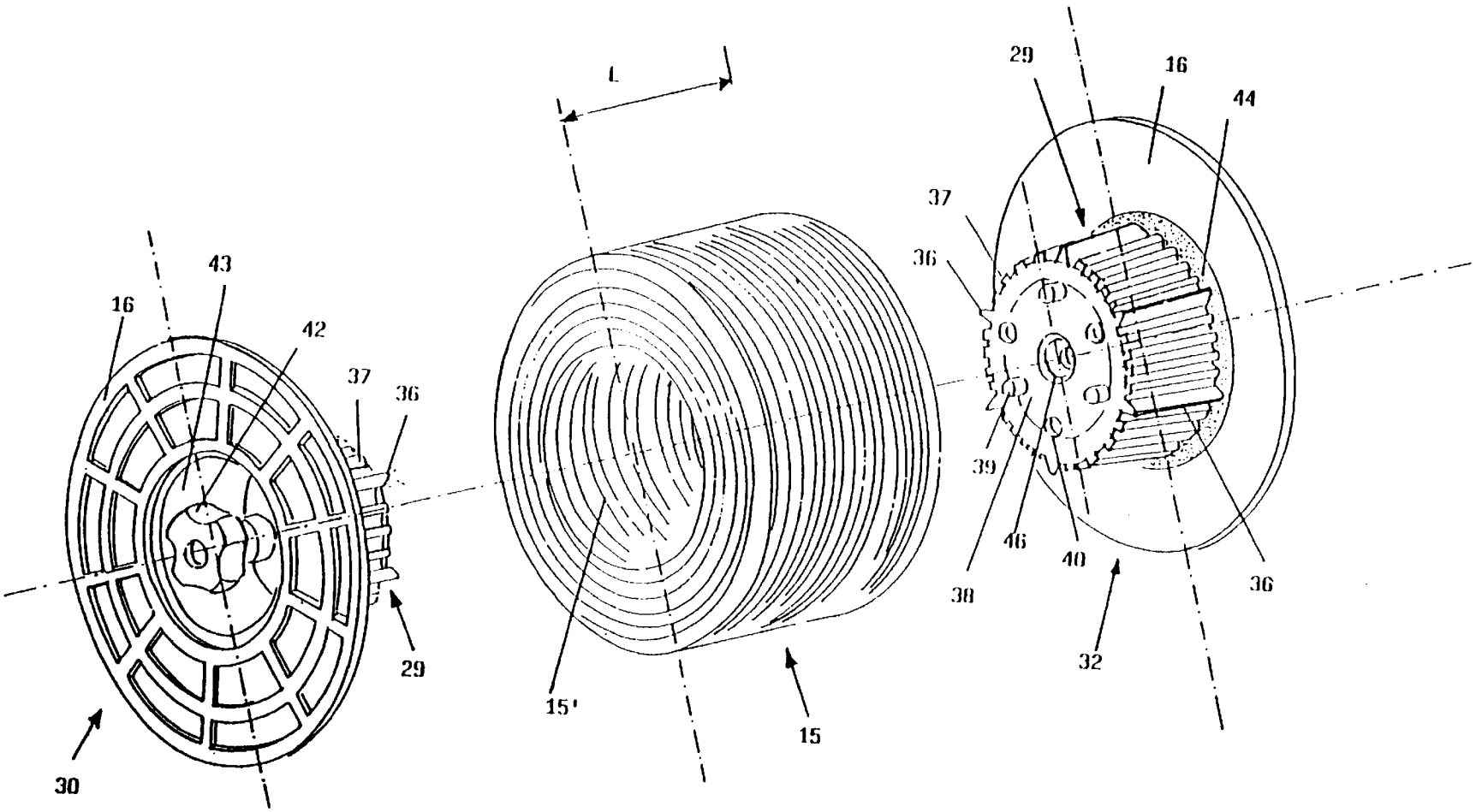
FIG. 4 is a partially exploded perspective view of the spool according to the present invention with a coil placed between the two flanges of the spool.
Figure 5:
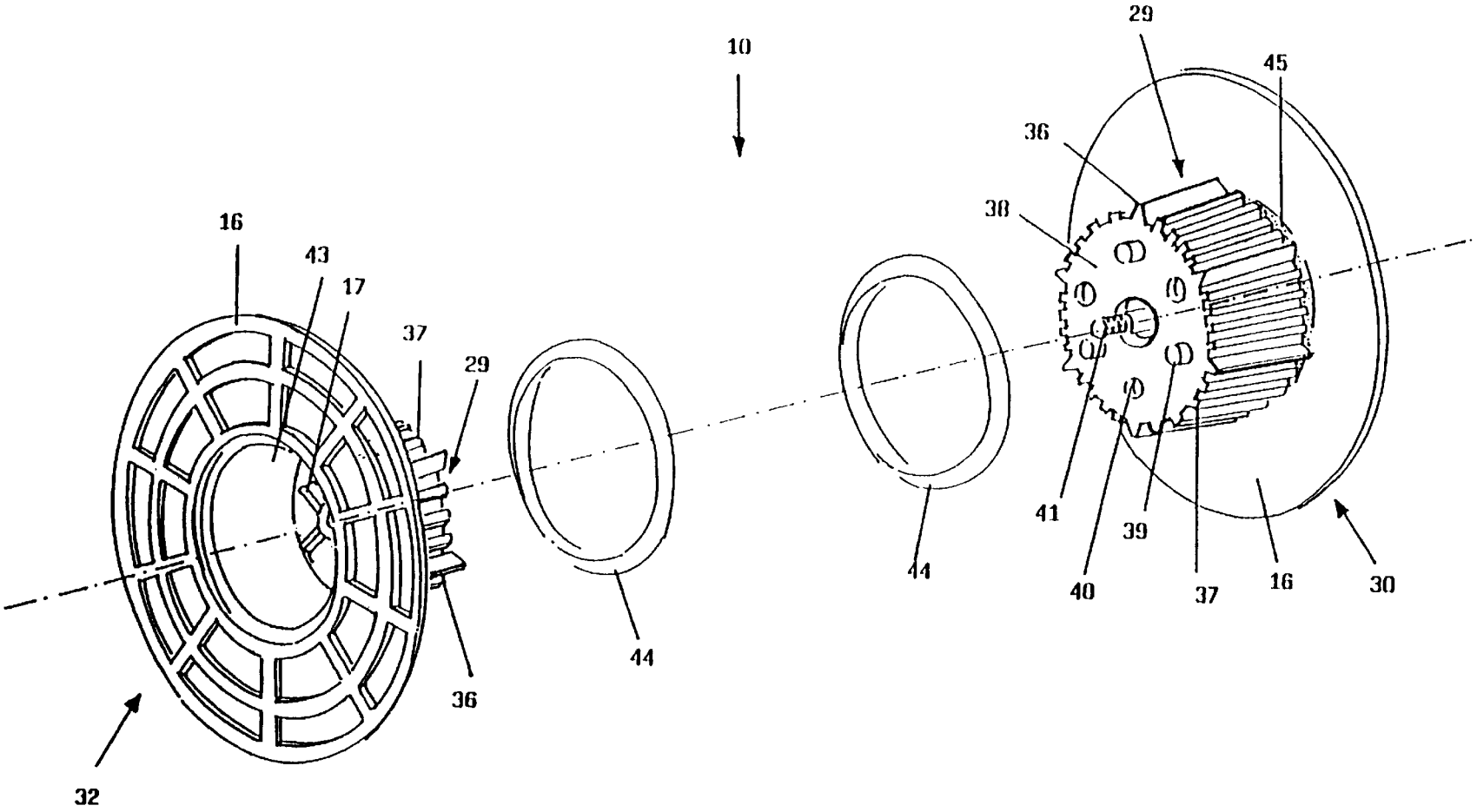
FIG. 5 is an exploded perspective view of the spool according to the present invention.

With reference to FIGS. 4 and 5, the reference numeral 12 generally designates 12 the spool according to the present invention, consisting of two flanges or half-spools, namely a male cable flange 30 and a female cable flange 32. The purpose of the spool 12 is to support a cable coil 15, which is usually supplied to the user, bound by clamps (not illustrated) to avoid its unrolling.

Each flange 30 and 32 has a preferably frusto-conical central section 29 preferably, with a fixed number of first ribs 36 of the same height, and second ribs 37 of the same height too, but shorter than the previous ones; these second ribs are provided to compensate the internal diameter gap of the coil 15.

In a preferred embodiment, there are six first ribs 36 and thirty second ribs 37.The shape of the first ribs is preferably triangular while that of the second ribs is rectangular or trapezoidal. Naturally, number and shape of these first and second ribs may change with regard to the foregoing description, without falling out of the scope of the invention.

Each flange 30 and 32 ends on the inner side with a surface 38 which, after the spool assembling, will be in mating contact with the inner surface 38 of the other one and, on the outer side with a plate 16 acting like a coil limitation shoulder.

To make easier the mutual assembling of the two flanges 30 and 32 protruding bolts 39 and respective centering holes 40 are provided on each surface 38: in other words, the protruding bolts 39 of the female flange 32 are inserted into the holes 40 of the male flange 30 and, similarly, the protruding bolts 39 of the male flange 30 are inserted into the holes 40 of the female flange 32, so that the various ribs 36 and 37 of the two flanges coincide and are continuous. The tapered shape of the flanges causes that, if the diameter of the hole 15' of the coil 15 would be larger than that of the flange near the surface 38, first ribs 36 would however engage, at least partially, the innermost turns constituting the walls of the hole 15' and the coil 15 would be in any case blocked by interference.

The two flanges are mutually locked by a thumbscrew 41 (FIG. 5) preferably provided with a knob 42 (FIG. 4) located inside the axial inner part 43 of the male flange 30: the thumbscrew threaded end is received into a threaded hole 46, made or obtained in the female flange 32.

The width L of the coil 15 is not always constant; in fact, during the coil 15 winding, it may occur that some windings have a width larger or smaller than the standard width L. In this case, when the coil is enclosed within the flanges 30 and 32, and the system as a whole is placed in the above described container mentioned above, it may occur that, since the coil 15 does not adhere perfectly to the outer shoulder plates 16 of the flanges 30 or 32, it is impossible to well unwind or rewind the cable of the coil itself. To prevent this, each flange is provided with an elastic ring 44 (FIG. 5) placed in a corresponding circular race 45 opposite to the surface 38, perfectly adjacent to the limitation shoulder 16. In so doing, the coil 15 is blocked between the elastic rings 44 which assure its dragging when the cable need to be rewound or unwound.

Once the coil 15 is inserted between the two flanges 30 and 32, mutually blocked by the thumbscrew 41, and the spool-coil unit is placed in the corresponding container 11 mentioned above, it is possible to unwind the cable by pulling its free end or to rewind itself on the coil 15 by acting on pins 17 of the female flange 32. Alternately to the pins 17, of course, it is possible to turn the spool 12 by opportunely rotating the knob 42; in this case, it must be taken care of placing the spool into its holder so that the knob rotation during the cable rewinding does not produce a screw loosening.

The spool 12 centering inside the container 11 is assured by the wheels 19 in the races 18 of which is housed the edge of the outer shoulder plates 16. The container internal size also does not allow the spool to move inside too much. The elastic strap 20, at last, fits in with the cable coil size and prevents it to be involuntarily unwound by pressing elastically on it.

At last, the various steps of spool loading and spool holder preparation according to the present invention will be briefly described, also referring to FIG. 6 which substantially reproduces a sample of label applied to the container rear side:

1) if present, the packaging thin film is taken off from the coil, thrown away and possibly recycled;
2) the coil, still bound by clamps, is threaded on the protruding part of a first flange, preferably placed on a support, and then the second flange is threaded so as to enclose the coil;
3) mutual adjustment and centering phases of the flanges take place;
4) the thumbscrew is tightened by acting on the knob;
5) after having lifted the container cover, the loaded spool is placed in it;
6) now the coil is in a safe position, then the clamps are cut;
7) the cover is closed and locked by acting on the door latches;
8) if desired, a shoulder-strap is anchored to the ring hooks on the cover; and
9) the user wears the shoulder-strap and the spool holder can be easily carried to the utilisation place.

Even if the preferred material for the spool and its relative holder is plastics and the implementing process is obtained by molding, it is possible to use other materials or other manufacturing methods. The illustrated and described container is made as a one piece, of course except for the cover.

It is clear that to the illustrated and described embodiment it is possible to make many changes, adjustments, variations and replacements of parts with other ones having same functionality without departing nevertheless from the scope defined by the appended claims.

What is claimed is:

1. A portable device for dispensing cables, comprising:

a spool holder of cable coils including a spool and a container having a cover for the introduction and extraction of said spool; and a plurality of wheels for supporting, centering and freely rotating said spool inside the container, the spool including a male and a female mutually mating flange, each of said male and female flanges having an inwardly projecting central part having a frusto conical shape for blocking the innermost turns of the cable coil and having a circular race adjacent the flange and an elastic ring inserted in said race, the cable coil being in contact with and trapped along the coil width between said elastic ring of said male flange and said elastic ring of said female flange.

2. The device according to claim 1, wherein each of the plurality of wheels of the spool holder includes a race having a base covered by an elastic band.

3. The device according to claim 1, further including an elastic strap to elastically push on an outermost winding of the cable coil arranged in the spool, said elastic strap being fixed on an inner surface of a rear side of the container and on an inner surface of a bottom of the container.

4. The device according to claim 1, wherein the container further includes a set of housings fixed on a front side of the container for holding tools.

5. The device according to claim 1, further including a label applied to the container, the label containing indicia instructing about spool loading and spool holder preparation.

6. The device according to claim 1, further including:

a shoulder strap operatively connected to the cover of the spool holder for conveying the spool holder.

7. The device according to claim 1, further comprising a plurality of anti-slide members fixed on a bottom of the container.

8. The device according to claim 1, further comprising at least one latch member, the at least one latch member releasably securing the cover to the container.

9. The device according to claim 1, wherein the projecting central part of the male and female flanges further includes a plurality of ribs extending radially therefrom.

10. The device according to claim 9, wherein the plurality of ribs includes a first set of ribs and a second set of ribs, the first set of ribs extending outwardly from the projecting central part a greater distance than the second set of ribs.

11. The device according to claim 10, wherein said first set of ribs are substantially triangular in cross-section.

12. The device according to claim 10, wherein the second set of ribs are substantially trapezoidal in cross-section.

13. The device according to claim 9, wherein the plurality of ribs includes a first set of ribs and a second set of ribs, said first set of ribs being substantially triangular in cross-section.

14. The device according to claim 13, wherein the second set of ribs are substantially trapezoidal in cross-section.

15. The device according to claim 9, wherein the plurality of ribs includes a first set of ribs and a second set of ribs, the second set of ribs being substantially trapezoidal in cross-section.

* * * * *